US007394335B2

(12) United States Patent
Chang et al.

(10) Patent No.: US 7,394,335 B2
(45) Date of Patent: Jul. 1, 2008

(54) POLARIZED HIGH-ORDER MODE ELECTROMAGNETIC WAVE COUPLER AND ITS COUPLING METHOD

(75) Inventors: Tsun-Hsu Chang, Hsinchu (TW); Ching-Fang Yu, Taoyuan (TW); Chao-Ta Fan, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 385 days.

(21) Appl. No.: 11/197,062

(22) Filed: Aug. 5, 2005

(65) Prior Publication Data

US 2007/0030097 A1 Feb. 8, 2007

(51) Int. Cl.
*H01P 5/12* (2006.01)
*H01P 1/16* (2006.01)

(52) U.S. Cl. ..... 333/137; 333/21 A; 333/21 R

(58) Field of Classification Search ..... 333/137, 333/21 A, 21 R

See application file for complete search history.

(56) References Cited

U.S. PATENT DOCUMENTS 3,569,870 A * 3/1971 Foldes ..... 333/21 R
6,470,858 B1 * 10/2002 Mattes ..... 123/467
7,208,710 B2 * 4/2007 Gregoire et al. ..... 219/697

* cited by examiner

*Primary Examiner*—Robert J. Pascal
*Assistant Examiner*—Kimberly E Glenn
(74) *Attorney, Agent, or Firm*—Egbert Law Offices

(57) ABSTRACT

The a polarized high-order mode electromagnetic wave converter and its coupling method, uses bifurcate structure to divide the input wave into two signals with the same amplitude but opposition phases, which are then inputted into a circular main waveguide through waveguide so that the input wave could convert into linearly polarized high-order mode in the main waveguide, and then undergo the polarization change conversion stage to convert the polarized wave into circularly polarized wave. The coupling method includes the electromagnetic wave bifurcate stage, mode conversion stage, and may combine with a polarization conversion stage. The TE21 coupler is tested with simulation computation and fabricated, and proved to product consistent results with the computer simulation. The coupler has features of high conversion efficiency, high mode purity, wide bandwidth, polarity control, and convenience in processing.

13 Claims, 10 Drawing Sheets

POLARIZED HIGH-ORDER MODE ELECTROMAGNETIC WAVE COUPLER AND ITS COUPLING METHOD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a safeguard device for the liquid container pump, and more particularly to a substrate that can be hooked or connected to the joint cap on top of the bottle cap of the container and the positioning chip on its upper end, and make the substrate and positioning chip connect to the joint cap and pump, and by effectively maintaining the unopened connection and pump to restrict the pump being opened easily by the consumers.

BACKGROUND OF THE INVENTION

TE21 waveguide converter has been widely applied in many fields, such as the generating microwave sources based on the interaction between the electron beam and TE21 waveguide mode; in R&D of plasma heating, circularly polarized TE21 mode is the best choice for generating symmetrical plasma; in application of antenna, TE21 mode could emit and receive differential signals with enhanced navigation.

There are two common methods for using cylindrical waveguide to generate TE21 mode, one is spiral/wave structure, and another is porous sidewall coupling. The former uses a deformed waveguide structure to gradually convert the wave to the desired mode; the conversion duration is long and different modes could be converted. The latter use a long and straight waveguide, which sidewall contains many coupling holes. Similar to the spiral converter, this type of converter requires longer conversion components and allows electric wave to convert to desired mode gradually. The surplus electric wave generated in the conversion process could affect the electron beams, and result in serious mode competition problem. Therefore, enhancing the conversion efficiency and improving the mode purity could prevent complicated mode competition problem.

Thus, to overcome the aforementioned problems of the prior art, it would be an advancement if the art to provide a polarized high-order mode electromagnetic wave coupler and its coupling method, which allows the coupler to have high conversion efficiency, high mode purity, broad bandwidth, polarized controllability, and simplified structure.

To this end, the inventor has provided the present invention of practicability after deliberate design and evaluation based on years of experience in the production, development and design of related products.

BRIEF SUMMARY OF THE INVENTION

The present invention provides a high efficiency TE21 mode conversion coupler, more specifically a polarized high-order mode electromagnetic wave coupler and its coupling method, the said conversion coupler has the following features, such as shortening of the conversion length, high conversion efficiency, high mode purity (99.99%), wide bandwidth, and polarity control.

At the present stage, the example based on the said principle is conversion from the standard rectangular waveguide TE10 mode to the linearly polarized or circularly polarized wave of the circular waveguide TE21 mode, the developmental method could derive the application of other high-order modes or mode conversion of other shapes of microwave tubes. Take TE21 conversion coupler for example, TE21 conversion coupler plays an important role in many applications, such as the generating high power microwave sources based on the interaction between the electron beam and TE21 waveguide mode; in R&D of microwave plasma heating, the distribution of the circularly polarized TE21 mode is expected to generate the uniform plasma; TE21 mode antenna radar could emit and receive different signals more effectively; it could also be applied further in other high-order modes.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
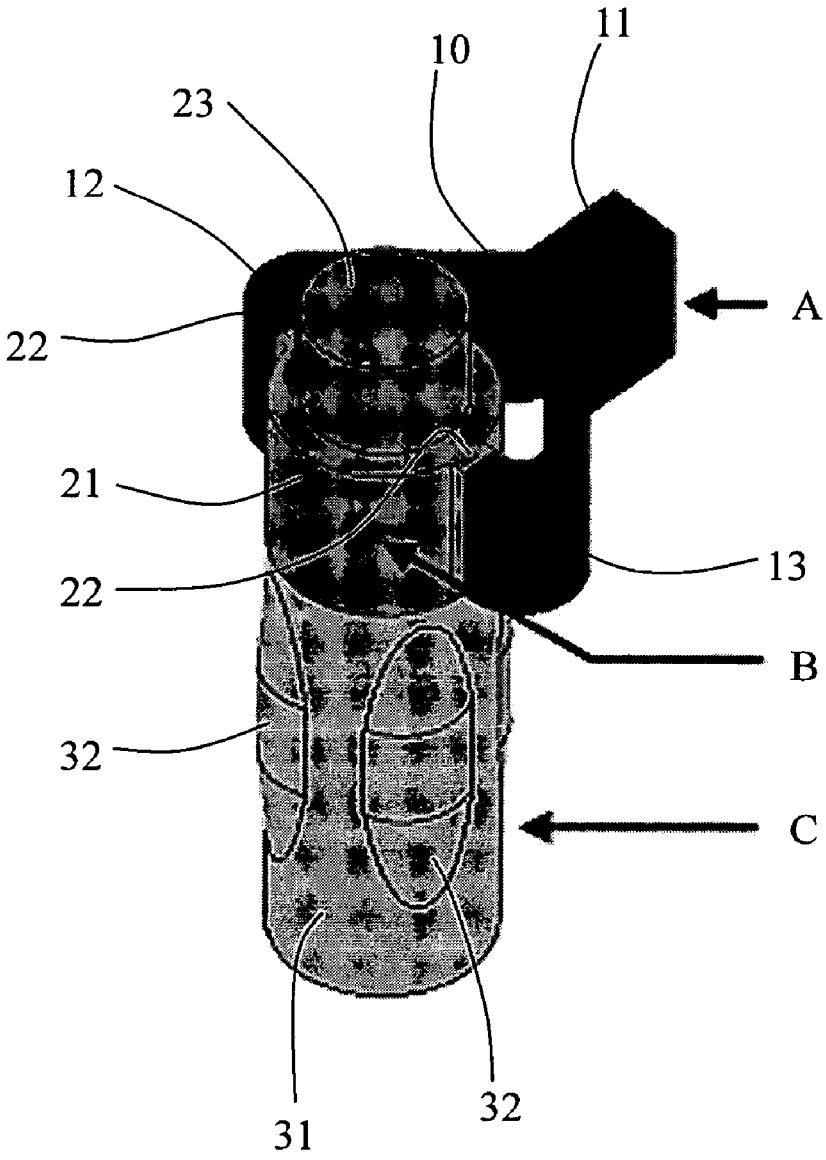
FIG. 1 shows an assembled perspective view of the electromagnetic wave coupler.

As shown in FIG. 1, there is the present invention.

The invention includes an electromagnetic wave bifurcation A, which input terminal is a rectangular waveguide 11, at the short side there are two rectangular waveguides 12 13, and the two rectangular waveguides 12 13 after bypassing are connected to the mode conversion device through curved waveguide.

There is a mode conversion device B, which is a main waveguide 21, which contains a coupling structure 22 on two side, and connects to the two waveguides 12 13 of the curved waveguide after bypassing an electromagnetic wave bifurcation A for coupling, and the main waveguide 21 could reduce its size on one end to form a waveguide chopper 23 to control the transmission frequency and bandwidth.

The invention may combine with a polarization conversion device C, which is connected to the back of the main waveguide 21 of the mode conversion device B, and the polarization conversion device C is a deformed waveguide 31, which has symmetric tapered structure 32 at the tube wall so that the two eigenmodes of the waveguide have different propagation constants, r0 and r1, and form two reciprocally sloped waveguide property axes with 45° angle, so that the wave of the two waveguide property axes could create a 90° differential phase, then form a circularly polarized wave that outputs from the deformed waveguide 31.

The electromagnetic wave bifurcation A, which included angle of the two post-bypass rectangular waveguides 12 13 could be less than 180° and form a Y-shaped structure, the width ratio for the short side of the post-bypass rectangular waveguide 11 and pre-bypass rectangular waveguide 12 13 is 0.01~1; the said mode conversion device B, the cross-sectional shape of the main waveguide 21 could be the effective coupling shape for the rectangular and cylindrical waveguide; the polarization conversion device C, which symmetric tapered structure 32 at the tube wall could form symmetric tapered concave or convex structure at four or more angled areas.

Based on the fabrication of the said component, the invention includes the polarized high-order mode electromagnetic wave coupling method.

The first step, is the electromagnetic wave bifurcate stage, and uses a Y-shaped waveguide 10 so that the two waveguide 12 13 of the post-bypass curved waveguide bifurcates the inputted wave into two waves which have the same amplitude but opposite directions (differential phase of 180°).

A second step is the mode conversion stage, and uses the main waveguide 21 so that the two waveguides 12 13 of the post-bypass curved waveguide after connected to the coupling bypass the two sides couple the two waves which have the same amplitude but opposite directions (differential phase of 180°) into one linearly polarized wave, and a waveguide chopper 23 to control the transmission frequency and bandwidth.

The method may combine with a third step, which is the polarization conversion stage, and uses a polarity change component with slight waveguide deform—deformed waveguide 31, which contains tapered convex (concave) structure 32, so that the two eigenmodes of the waveguide have different propagation constant, r0 and r1, and the deformed waveguide 31 has two reciprocally sloped waveguide property axes with 45° angle, so that to separate one linearly polarized wave into two with the same amplitude and allow the wave of the two waveguide property axes could form 90° differential phase in the forward distance, then form a circularly polarized wave to be outputted from the deformed waveguide.

For the circularly polarized TE21 mode converter of the present invention, the mode conversion process is divided into three stages. The first stage is power bifurcate stage, in which the wave inputted from the rectangular waveguide 11 is divided into two signs which have the same amplitude but also negation sign (differential phase of 180°); the second stage is the mode conversion stage, in which the signal is projected into a cylindrical waveguide to form a pure linearly polarized TE21 mode; and may combine with the third stage which is the polarization change stage, in which the just formed linearly polarized TE21 mode is conducted through a squarely protruding cylindrical component so as to form circularly polarized TE21 mode in the deformed waveguide 31; the operating principles and design details of each stage are discussed in the following.

A. Power Bifurcate Stage: Lower the Input Reflection to the Minimum

Figure 2A:
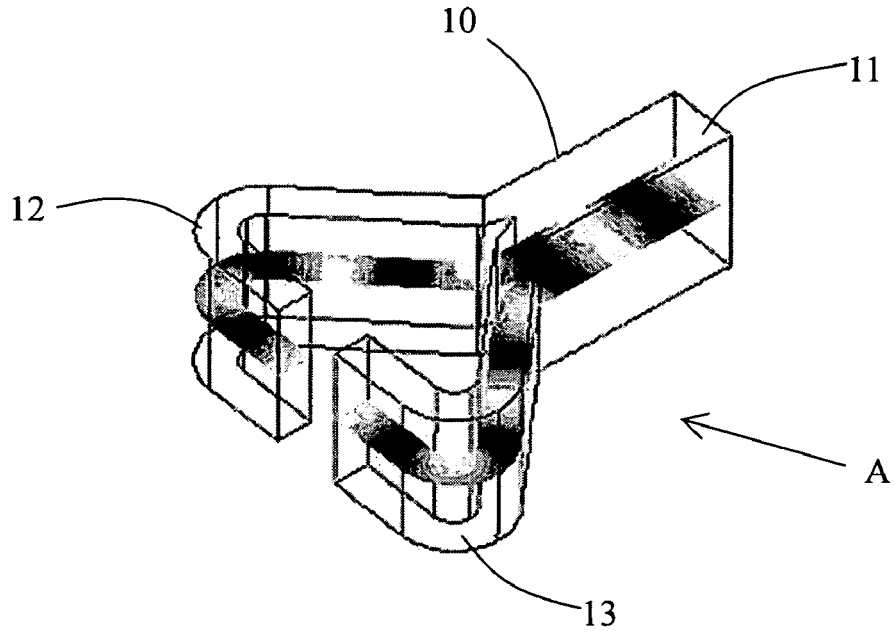
FIG. 2*a* shows a cross-sectional view of the electric field strength distribution of the rectangular waveguide in the power bifurcate stage.
Figure 2B:
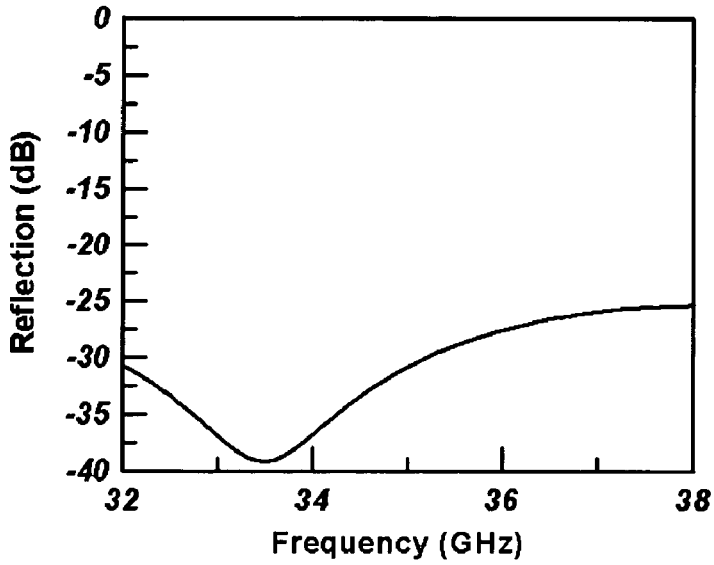
FIG. 2*b* shows a graph illustration of the reflection frequency response of the rectangular waveguide input terminal.

Forming a TE21 mode with field property requires two signals which have the same amplitude but also opposite phases, and Y-shaped waveguide could provide such result; FIGS. 2*a* and 2*b* show the simulation results of a high frequency structural simulator (HFSS, Ansoft); though the three port connectors could not be used on all three ports at the same time, geometry principle could be applied to reduce the reflection of the input port—rectangular waveguide 11 to the minimum; FIG. 2*a* shows the distribution of electric field strength of the middle section transection of the rectangular waveguide in the power bifurcate stage; FIG. 2*b* shows the reflection of the rectangular waveguide 11 against the frequency, wherein the two waveguide 12 13 of the post-bypass curved waveguide is designed to completely shut to prevent the effect of multiple reflection, the reflection shown in the figure is under 25 dB within the entire bandwidth.

B. The Mode Conversion Stage: Optimize the Transmission Effect

Figure 3A:
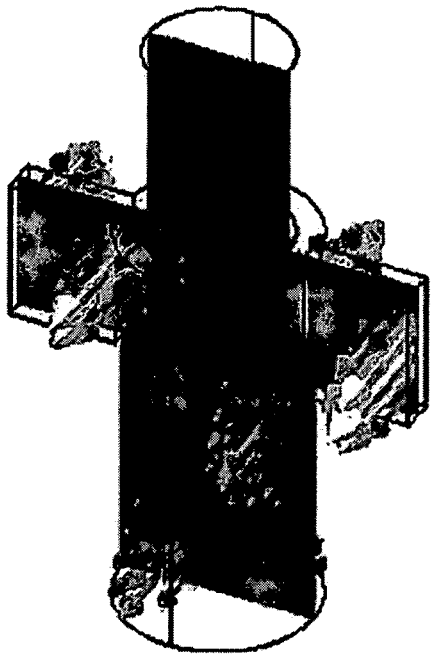
FIG. 3*a* shows a cross-sectional view of the electric field distribution of the electromagnetic wave coupler using HFSS.

At the end of the first stage, two signals which have the same amplitude but also the negation sign are generated, which could work together to produce the linearly polarized TE21 mode; using the field property of TE21 mode, the mode produced by the two signals with the negation sign for azimuthul 180° separation, and the size of the sidewall coupling structure 22 for optimization to provide effective coupling between the rectangular and cylindrical waveguide. FIG. 3 shows the cross-sectional view of the electric field using HFSS, the electric wave projected into the two waveguides 12 13 of the post-bypass curved waveguide form a linearly polarized TE21 in the main waveguide 21.

Figure 3B:
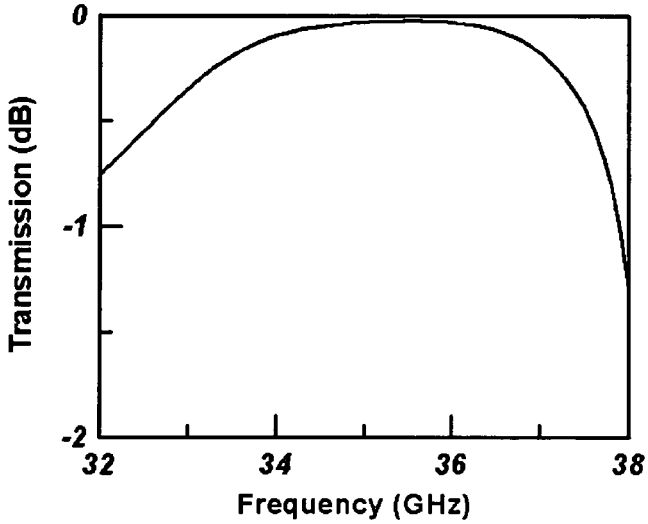
FIG. 3*b* shows a graph illustration of the transmission frequency response from the two rectangular TE10 modes to circular TE21 mode of the electromagnetic wave coupler.

The end of another side of the cylindrical main waveguide 21 is placed with a microwave short circuit, the waveguide chopper 23 in FIG. 1; the short circuit is a circular tube, which inner diameter is small enough to obstruct the design mode and large enough to allow the electron beams to pass; whereas the position of the short circuit could affect the receiving frequency and bandwidth; FIG. 3*b* shows transmission frequency response, and the transmission content is ratio obtained from dividing the <TE21 of main waveguide 21> of the required power by the <TE10 of the two waveguides 12 13 of the post-bypass curved waveguide> of the total input power.

C. The Polarization Change Stage: Control the Differential Phase

When the linearly polarized TE21 wave moves forward in the cylindrical main waveguide 21, it enters a polarity change component with slight waveguide deform—deformed waveguide 31. The deformed waveguide 31 has two property axes, represented by r0 and r1, which are reciprocally sloped in 45° angle; a linearly polarized TE21 wave is separated into two linearly polarized TE21 waves which have the same amplitude, and the propagation constant property of each wave is determined by the waveguide radius r0 and r1; when the forward distance of the two waves form a 90° differential phase, the two wave combine into a circularly polarized wave.

Figure 4:
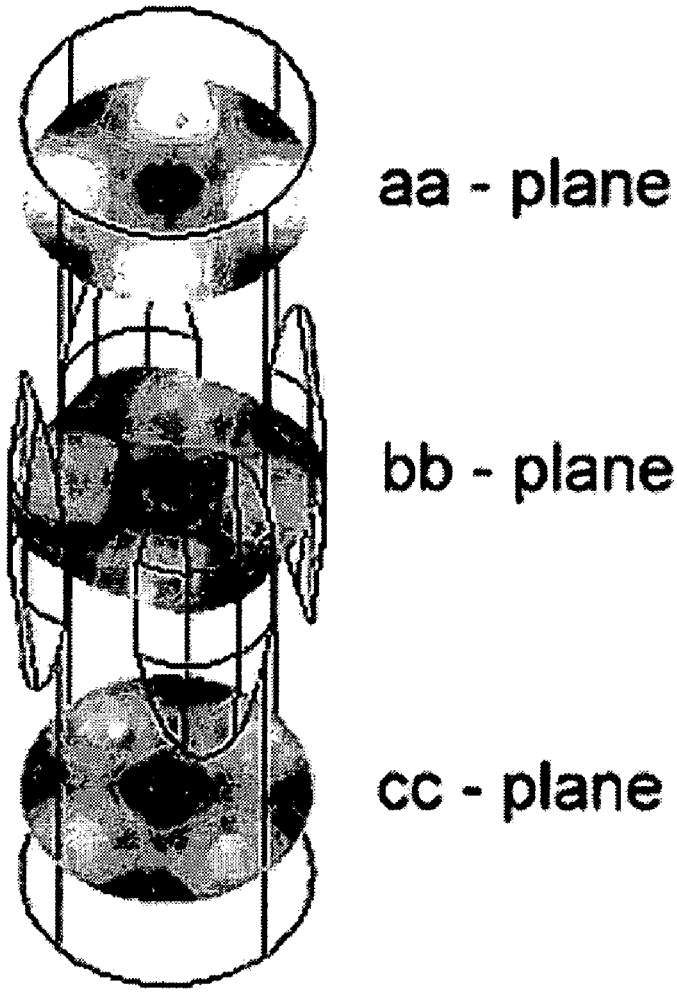
FIG. 4 shows the cross-sectional view of the electric field distribution of the electromagnetic wave coupler in three different surfaces.

FIG. 4 shows the cross-sectional views of the electric field distribution of three different surfaces: aa surface (linearly polarized, before conversion), bb surface (elliptically polarized, during conversion), and cc surface (circularly polarized, after conversion); it is worth noting that the displayed field mode is the electric field distribution at the same time, and that is the reason for the circularly polarized polarity looks similar to the linear polarity; in actual operation, the field mode of the circular polarity will circulate, and appropriately designed differential phase could control the polarity; and if the deformed waveguide 31 could be eliminated, the linearly polarized wave could be resumed.

Figure 5A:
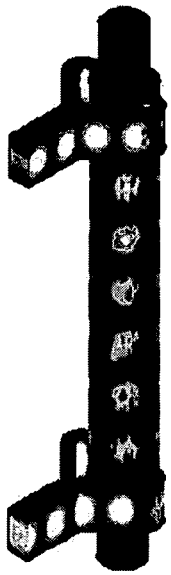
FIG. 5*a* shows a perspective view of the electric field strength distribution of HFSS that connects the two similar linearly polarized electromagnetic wave couplers.
Figure 5B:
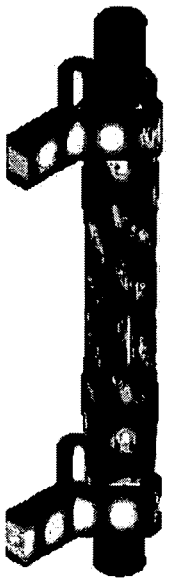
FIG. 5*b* shows another perspective view of the electric field strength distribution of HFSS that connects the two similar circularly polarized electromagnetic wave couplers.

Based on the said reciprocity, the two same conversion couplers could be connected to produce the model, and the simulation results of the electric field strength of two conversion couplers with the same linear polarity are shown in FIG. 5*a*; FIG. 5*b* shows the simulation results for the two conversion couplers with the same circularly polarity; the electric field has no polarity that could changed the linearly polarized condition, but the dextrorotatory circularly polarized electric field rotates counterclockwise.

Figure 6A:
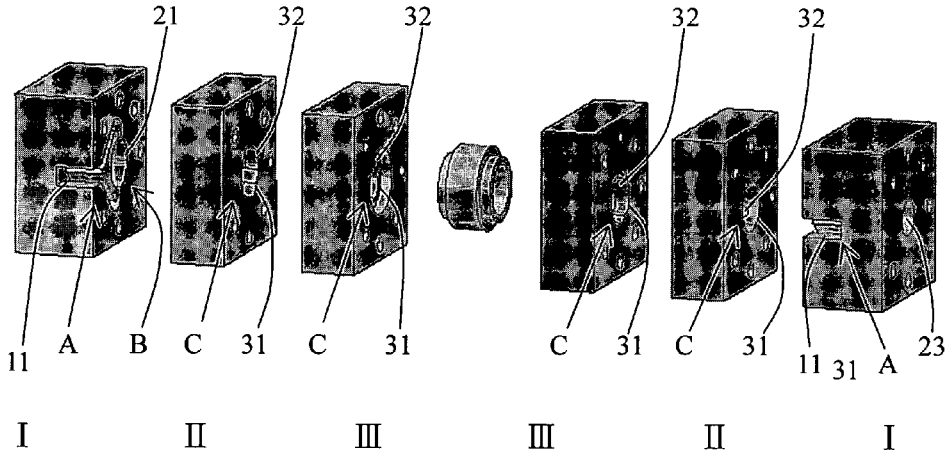
FIG. 6*a* shows an exploded perspective view of the two connecting electromagnetic wave couplers.

FIG. 6*a* shows the design of two similar couplers, which constructs a circularly polarized converter that operates on Ka frequency range, I part comprises two components, which are electromagnetic wave bifurcation A and mode conversion device B, the rectangular TE10 mode is converted to linearly polarized TE21 in the cylindrical main waveguide 21; ? and ? part are polarization conversion device C, as seen from the cross-sectional view, one of which is deformed—tapered structure 32, and another adjusts it; the taper angle and length use HFSS for optimization, and the ratio of r0 to r1 is designed to be close to 1, so as to prevent reflection resulted from inconsistent structure, yet the difference of the ratio is large enough to allow the conversion time to remain the lowest, while the lower r1/r0 ratio requires longer components to create a differential phase for two right angle waves at 90°, the optimal length could be determined based on the size limit of specified application procedure and coupling efficiency; the compromised design is a conversion component with length of 2.0 cm, average radius of 0.48 cm (r0), maximum deformed radius ratio of 0.53 cm (r1), and a 1.0 cm central unified component to connect the two converters.

Figure 6B:
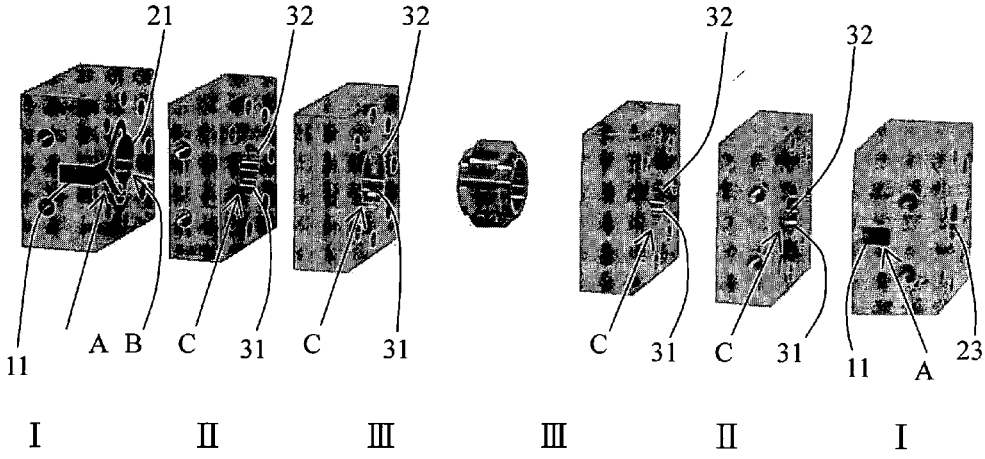
FIG. 6*b* shows the model decomposition perspective view of the two connecting electromagnetic wave couplers.

FIG. 6*b* shows the assembled components, which all made with bronze, lathed with CNC, with tolerance of 0.01 mm, and affixed with thin needle to ensure all components are connected tightly and accurately.

Figure 7A:
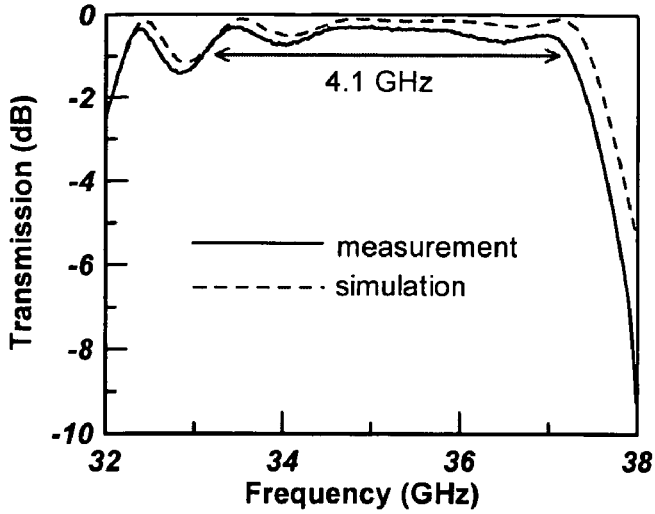
FIG. 7*a* shows a graph illustration of the transmission frequency response of the two similar linearly polarized electromagnetic wave couplers.
Figure 7B:
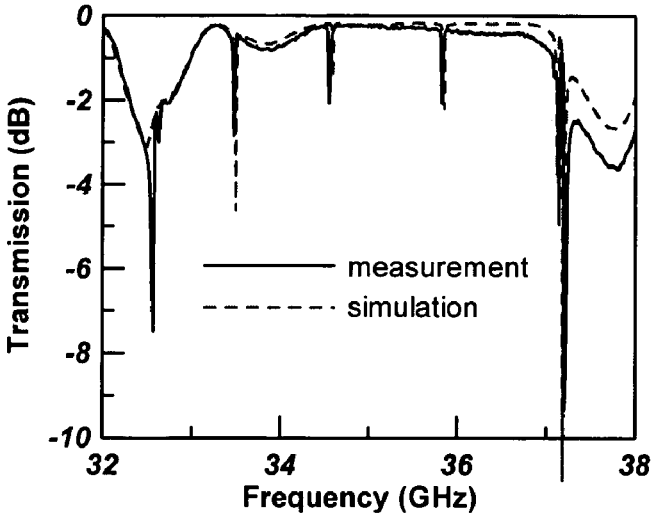
FIG. 7*b* shows a graph illustration of the transmission frequency response of the two similar circularly polarized electromagnetic wave couplers.

FIGS. 7*a* and 7*b* show the butt transmission of the linear and circular polarizations, which transmission method is often used to demonstrate the coupling performance; the simulation and measurement assembly is similar to that shown in FIG. 5, except for the central unified length is only 1.0 cm; the experiment uses dual-port vector network analyzer (VNA, Agilent 8510C) for measurement, and produces results consistent with that of the simulation; the computation results show that the conversion loss is mainly due to ohm loss of the bronze wall; the optimal continuous conversion efficiency is shown below: the bandwidth of linear polarization (FIG. 7*a*) is 4.1 GHz when the penetration is 1 dB, and the conversion efficiency of the circular polarization (FIG. 7*b*) is superior when receiving frequency, but dips could damage the levelness of the spectrum (such as the dips of 33.6, 34.5, and 35.95 GHz).

Multiple reflection is the cause of the dip, as in linear polarization, the reflection produced by the sidewall coupling is optimized in the mode conversion component, thus making the effect of multiple reflection insignificant, but in circular polarization, reflection may occur to some waves due to improper polarization between the two ends, and result in excessive resonance effect; however, single conversion coupler is used in many application procedures, the discussion on the conversion efficiency and mode purity of single coupler would be beneficial.

Figure 8:
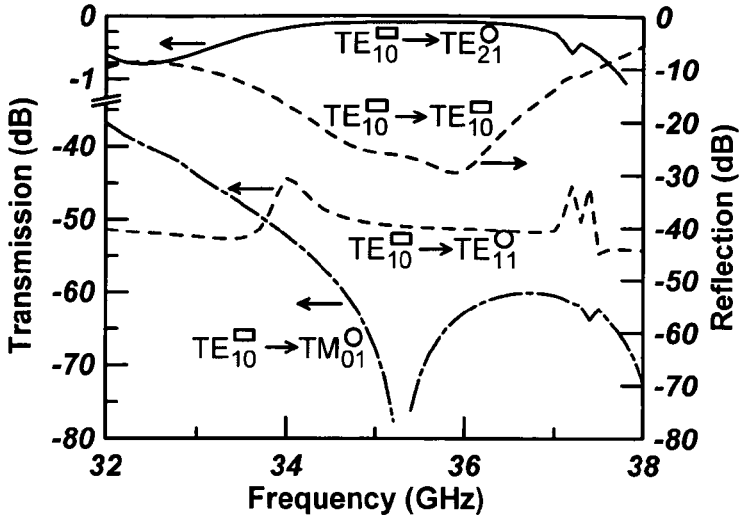
FIG. 8 shows a graph illustration of the transmission frequency response and reflection response of the single circularly polarized electromagnetic wave coupler.
Figure 9:
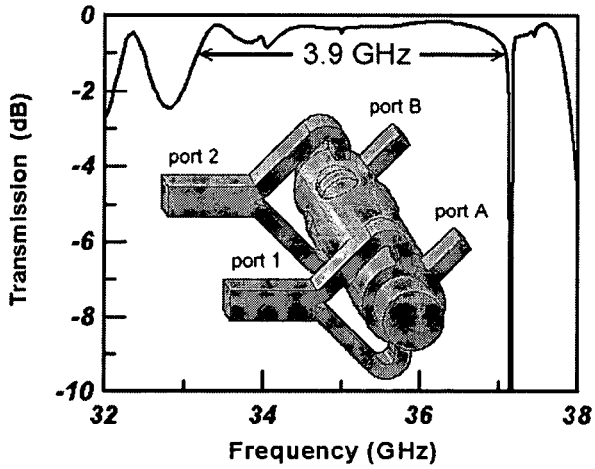
FIG. 9 shows a graph illustration of the transmission frequency response of the two similar circularly polarized electromagnetic wave coupler with external waveguide and perspective view of the coupler.

FIG. 8 shows the efficiency of the single circularly polarized TE21 conversion coupler based on the computation and the reflection of its frequency; a rectangular TE10 wave is projected into the rectangular waveguide 11, and converted into three cylindrical waveguide modes in the deformed waveguide 31, whereas the three modes include the required TE21 mode and unnecessary TE11 and TM01 modes, and conversion efficiency is defined as the ratio between any wave inputted by the cylindrical waveguide mode and the wave inputted by rectangular TE10 mode; the bandwidth is 3.9 GHz when the computed penetration is above 0.5 dB and conversion efficiency is 99%; the transmission result shows high mode purity (as high as 99.99%), and the figure shows the reflection of the rectangular waveguide 11; the high consistency between the results of butt transmission computation and measurement proves that the simulation result of the single conversion coupler has high reliability. As for solving the resonance effect of the circularly polarized wave as a result of multiple reflection, effectively removing specific unwanted linearly polarized wave is a feasible method; FIG. 9 shows the installation of a rectangular waveguide at the 45° difference between the side of the main waveguide and the original coupling structure so as to induce unwanted linearly polarized wave; the program computation proves the method to be effective in soling the dip in the butt measurement of circularly polarized electromagnetic wave coupler.

Figure 10:
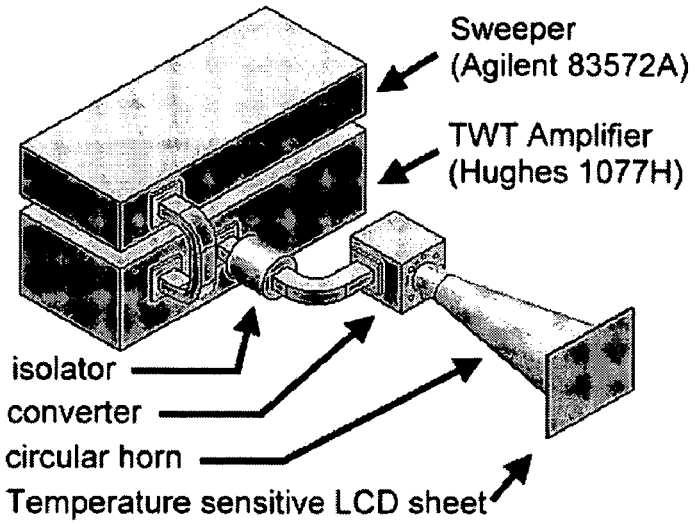
FIG. 10 shows a perspective view of the structural drawing of the experimental disposition used to measure the field distribution mode directly.

Although the results of the continuous simulation and measurement are consistent, further evidences are needed to prove the effectiveness of the conversion coupler, and one of the methods is displaying the field mode of TE21; FIG. 10 shows the structural drawing of the field distribution in the experiment disposition, in which a microwave magnifier (Hughes 1077H) provides 0.5 W of RF power, and a signal generator (Agilent 83572A) adjusts the frequency, a temperature-sensory LCD display chip that absorbs the microwave energy to enhance the local temperature is placed in front of the tapered cone, the LCD display chip displays full-color spectrum for temperature range from 25 to 30°, and the displayed full-color spectrum is consistent with the field energy distribution, thus, allowing the field mode to be observed with the naked eyes.

Figure 11A:
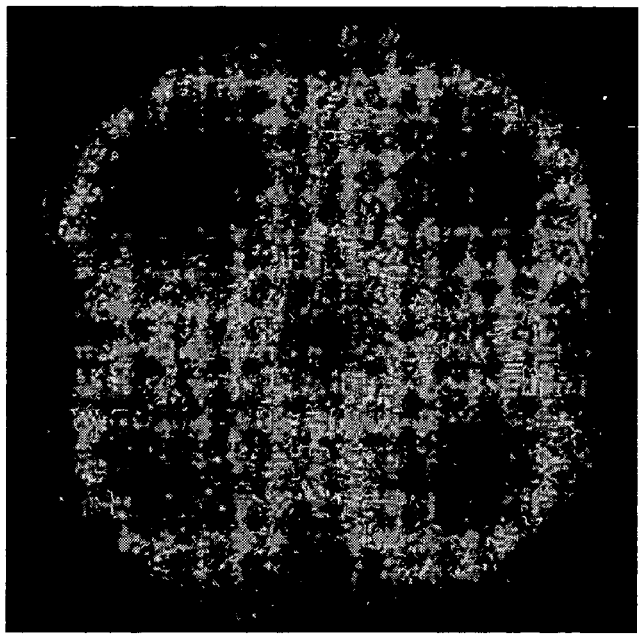
FIG. 11*a* shows a photograph illustration of the experiment results of the measured field distribution mode of the linearly polarized electromagnetic wave coupler.
Figure 11B:
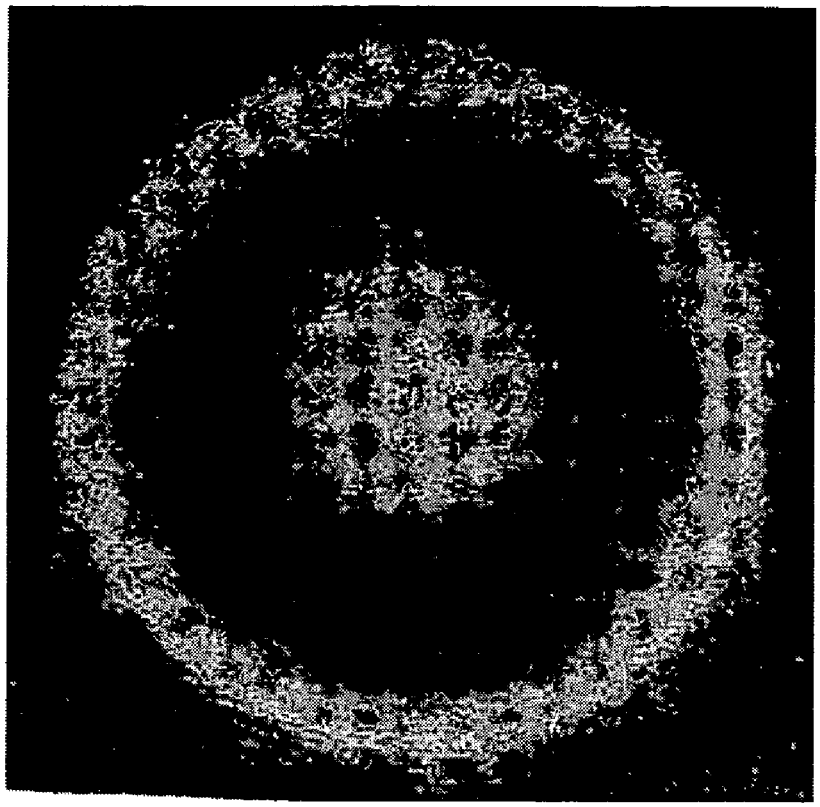
FIG. 11*b* shows another photograph illustration of the experiment results of the measured field distribution mode of the circularly polarized electromagnetic wave coupler.

FIGS. 11*a* and 11*b* show the measuring results of the average field strength, in which FIG. 11*a* is a linearly polarized TE21 mode, and the field mode has four peaks, each one occupies one quadrant; to circularly polarized TE21 wave, field mode alternates in the time frequency as the wave frequency, only the average time results are displayed on the LCD chip. FIG. 11*b* shows the distribution mode of the circularly polarized field, and its azimuths are clearly symmetrical, which is the proof of circular polarization, and the elliptical polarity of the TE21 mode shows asymmetrical azimuths; when needed mode is mixed with an unwanted mode could produce strange field mode.

I claim:

1. A polarized high-order mode electromagnetic wave coupler comprising:

a power-dividing section in which an input wave is divided into two equal amplitude signals through a Y-shaped power divider;

a mode-forming structure in which the two equal-amplitude signals are coupled through a sidewall to form a TE21 wave guide mode with linear polarization; and a polarization conversion section having a slightly deformed waveguide to control the polarization of the TE21 wave through a phase control.

2. The wave coupler of claim 1, said power-dividing section having a included angle of the Y-shaped power divider of less than 180°, a width ratio for a short side of a post-bypass rectangular waveguide and pre-bypass rectangular waveguide being between 0.01 and 1.

3. The wave coupler of claim 1, said polarization conversion section having a tube wall with at least four segments having a tapered concave or convex structure.

4. A polarized high-order mode electromagnetic wave coupling method comprising: bifurcating an inputted wave into two waves having an identical power level; coupling the two waves into one linearly polarized wave; controlling a transmission frequency and bandwidth of the linearly polarized wave with a wave chopper; separating the one linearly polarized wave into a pair of waves with an identical power level using a deformed waveguide with two different property axes degeneracy waveguide modes; allowing the pair of waves to have a differential phase in a forward direction; outputting the pair of waves from said deformed waveguide.

5. A polarized high-order mode electromagnetic wave coupling method comprising: bifurcating an inputted electromagnetic wave into two waves each having an identical power level; coupling the two waves into a single linearly polarized wave; and controlling a transmission frequency and bandwidth of the single linearly polarized wave by using a waveguide chopper.

6. The method of claim 5, further comprising: separating the single linearly polarized wave into two waves each having an identical power level by using a deformed waveguide with two different properly axes degeneracy waveguide modes; allowing the separate two waves to have a differential phase in a forward direction; and outputting the separate two waves from said deformed waveguide.

7. A polarized high-order mode electromagnetic wave coupling method comprising: bifurcating an inputted electromagnetic wave into two waves each having an identical power level using a Y-shaped waveguide, two waveguides of a post-bypass curved waveguide causing the bifurcating of the inputted electromagnetic wave; using a main waveguide such that the two waveguides of said post-bypass curved waveguide couple the two waves into a single linearly polarized wave; controlling a transmission frequency and bandwidth of the single linearly polarized wave with a waveguide chopper; separating the single linearly polarized wave into two waves each having a identical amplitude and a differential phase in a forward direction, the separating using a polarity change component with a slightly deformed waveguide, said deformed waveguide having a tapered concave or convex structure such that two eigennodes of the deformed waveguide have different propagation constants, said deformed waveguide having a pair of degeneracy modes with different axis; and outputting the separated two waves from said deformed waveguide.

8. A polarized high-order mode electromagnetic wave coupling method comprising: bifurcating an inputted wave into two waves each having an identical power level using a Y-shaped waveguide with two waveguides of a post-bypass curved waveguide; using a main waveguide such that said two waveguides after connecting to a coupling bypass two sides so as to couple the two waves into a single linearly polarized wave; and controlling a transmission frequency and bandwith of the single linearly polarized wave with a waveguide chopper.

9. The method of claim 8, further comprising:

separating the single linearly polarized wave into a pair of waves each having an identical amplitude and differential phase in a forward direction by using a polarity change component with a slightly deformed waveguide, said slightly deformed waveguide having a tapered concave or convex structure such that two eigennodes of the slightly deformed waveguide have different propagation constants, said slightly deformed waveguide having a pair of degeneracy modes with different axes.

10. A polarized high-order mode electromagnetic wave coupler comprises:

a power-dividing section having an input wave divided into two equal-amplitude signals through a Y-shaped power divider thereof; and a mode-forming structure coupling the two equal-amplitude signals through a sidewall to form a TE21 wave guide mode with linear polarization.

11. The wave coupler of claim 10, further comprising:

a polarization conversion section having a slightly deformed waveguide to control the linear polarization of the TE21 wave through phase control.

12. The wave coupler of claim 11, said polarization conversion section having a tapered concave or convex structure of at least four segments of a tube wall thereof.

13. The wave coupler of claim 10, said power dividing section having an included angle of the Y-shaped power divider of less than 180°, a width ratio for a short side of a post-bypass rectangular waveguide and pre-bypass rectangular waveguide of 0.01 to 1.

* * * * *